US007398615B2

(12) United States Patent
Wheatley

(10) Patent No.: US 7,398,615 B2
(45) Date of Patent: Jul. 15, 2008

(54) FIREARM MAGAZINE WITH POSITION ADJUSTMENT

(76) Inventor: Craig Wheatley, HCR 85 Box 8024, Bonners Ferry, ID (US) 83805

( * ) Notice: Subject to any disclaimer, the term of this patent is extended or adjusted under 35 U.S.C. 154(b) by 206 days.

(21) Appl. No.: 11/510,481

(22) Filed: Aug. 23, 2006

(65) Prior Publication Data

US 2007/0119086 A1 May 31, 2007

Related U.S. Application Data

(60) Provisional application No. 60/739,833, filed on Nov. 28, 2005.

(51) Int. Cl.
*F41A 9/61* (2006.01)

(52) U.S. Cl. ..... 42/49.01

(58) Field of Classification Search ..... 42/49.01, 42/49.02, 50, 6

See application file for complete search history.

(56) References Cited

U.S. PATENT DOCUMENTS 3,736,686 A * 6/1973 Moller et al. ..... 42/6
4,069,608 A * 1/1978 Jurek ..... 42/49.02
4,790,094 A * 12/1988 Chesnut et al. ..... 42/50
4,862,620 A * 9/1989 Chesnut et al. ..... 42/50
4,864,758 A * 9/1989 Crossman ..... 42/18
5,056,252 A * 10/1991 Velezis ..... 42/50
5,664,355 A * 9/1997 Ronkainen ..... 42/18
6,367,188 B1 * 4/2002 Vargas ..... 42/106
7,194,837 B2 * 3/2007 Obong ..... 42/90
7,318,294 B2 * 1/2008 Zimmermann ..... 42/7
2004/0148838 A1 * 8/2004 Conner ..... 42/49.01
2005/0115128 A1 * 6/2005 Hahin ..... 42/50

* cited by examiner

*Primary Examiner*—Michael J. Carone
*Assistant Examiner*—Michael D David
(74) *Attorney, Agent, or Firm*—Langlotz Patent Works Inc.; Bennet K. Langlotz

(57) ABSTRACT

A magazine for a firearm having a magazine well has a body with the chamber for receiving ammunition. The body has an upper opening to the chamber, and has a contact portion with adjustable screws that contact a surface in the magazine well. Adjustment of the screws is used to establish a precise selected position of the magazine with respect to the receiver, permitting adjustment of the feed height, feed angle and ejector position. Four screws are provided, one at each corner of the upper surface of the magazine.

9 Claims, 5 Drawing Sheets

FIREARM MAGAZINE WITH POSITION ADJUSTMENT

REFERENCE TO RELATED APPLICATION

This non-provisional patent application is related to provisional application for patent application No. 60/739,833, filed Nov. 28, 2005, entitled "Adjustable Position Firearm Magazine".

FIELD OF THE INVENTION

This invention relates to ammunition magazines, and more particularly to detachable magazines for firearms.

BACKGROUND AND SUMMARY OF THE INVENTION

Firearm receivers that utilize a magazine designed for Ruger model 10/22 firearms all have dimensional differences in the area where the magazine mates with the receiver. Even firearms from the same manufacturer of the same model designation have differences in the receiver dimensions. As a result, existing available magazines have had to be manufactured with sufficiently loose fits to enable them to try to fit as many combinations of receivers as possible, with the accompanying result that they do not fit any one receiver very well, to the performance detriment of the firearm.

Function of a firearm is directly related to the fit of the magazine in the receiver, so loose fitting magazines may cause unreliable firearm functioning. On the other hand, the more exactly the magazine fits the firearm receiver, the more reliable the function of the firearm can be expected to be. This is in conflict with the need to manufacture loose fitting magazines to ensure insertability in receivers that are of varying tolerances from the manufacture's intended optimal design specification.

In addition, even if all receivers were manufactured to dimensional perfection manufacturing variations in magazines may generate unreliability. Further, different brands and lots of ammunition may require different dimensional relationships between a magazine and the receiver.

There is a need for a magazine that fits into a wide range or receiver tolerances, with reliable function in each.

The present invention overcomes the limitations of the prior art by providing a magazine for a firearm having a magazine well that has a body with the chamber for receiving ammunition. The body has an upper opening to the chamber, and has a contact portion with adjustable screws that contact a surface in the magazine well. Adjustment of the screws is used to establish a precise selected position of the magazine with respect to the receiver, permitting adjustment of the feed height, feed angle and ejector angle. Four screws are provided, one at each corner of the upper surface of the magazine.

DETAILED DESCRIPTION OF A PREFERRED EMBODIMENT

Figure 1:
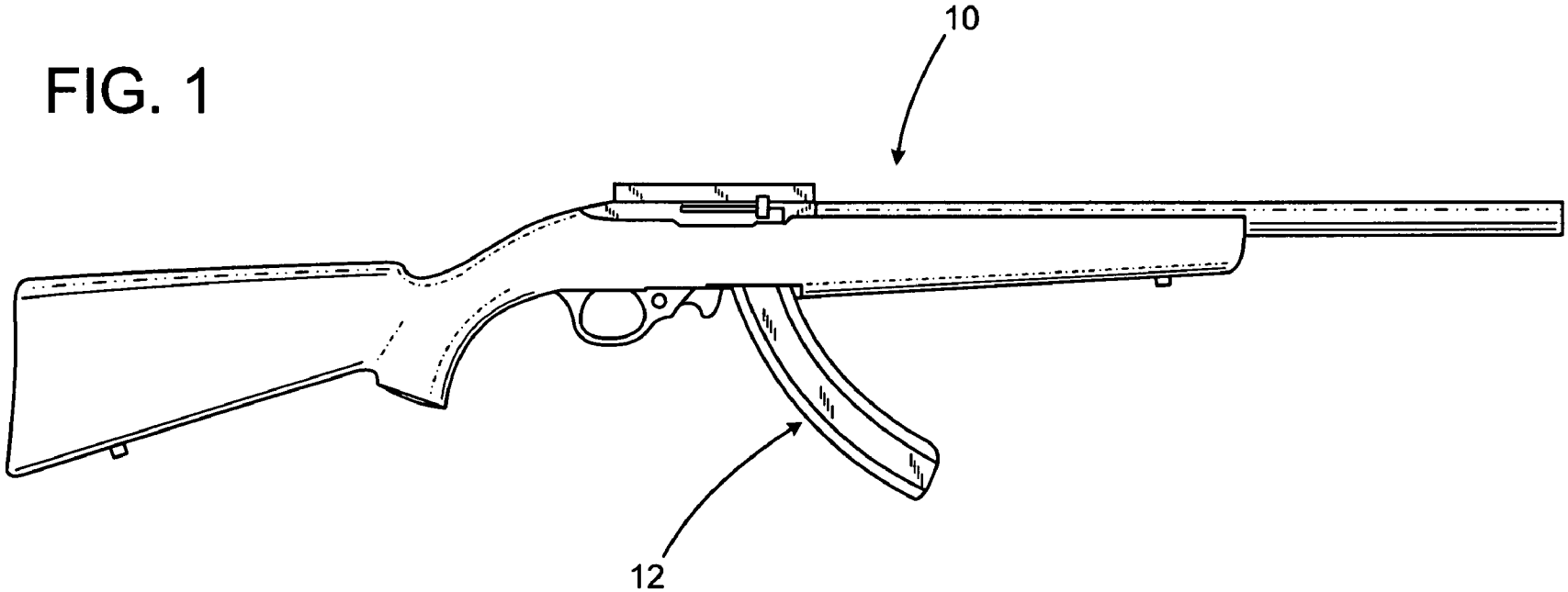
FIG. 1 is a side view of a firearm with a magazine according to a preferred embodiment of the invention.
Figure 2:
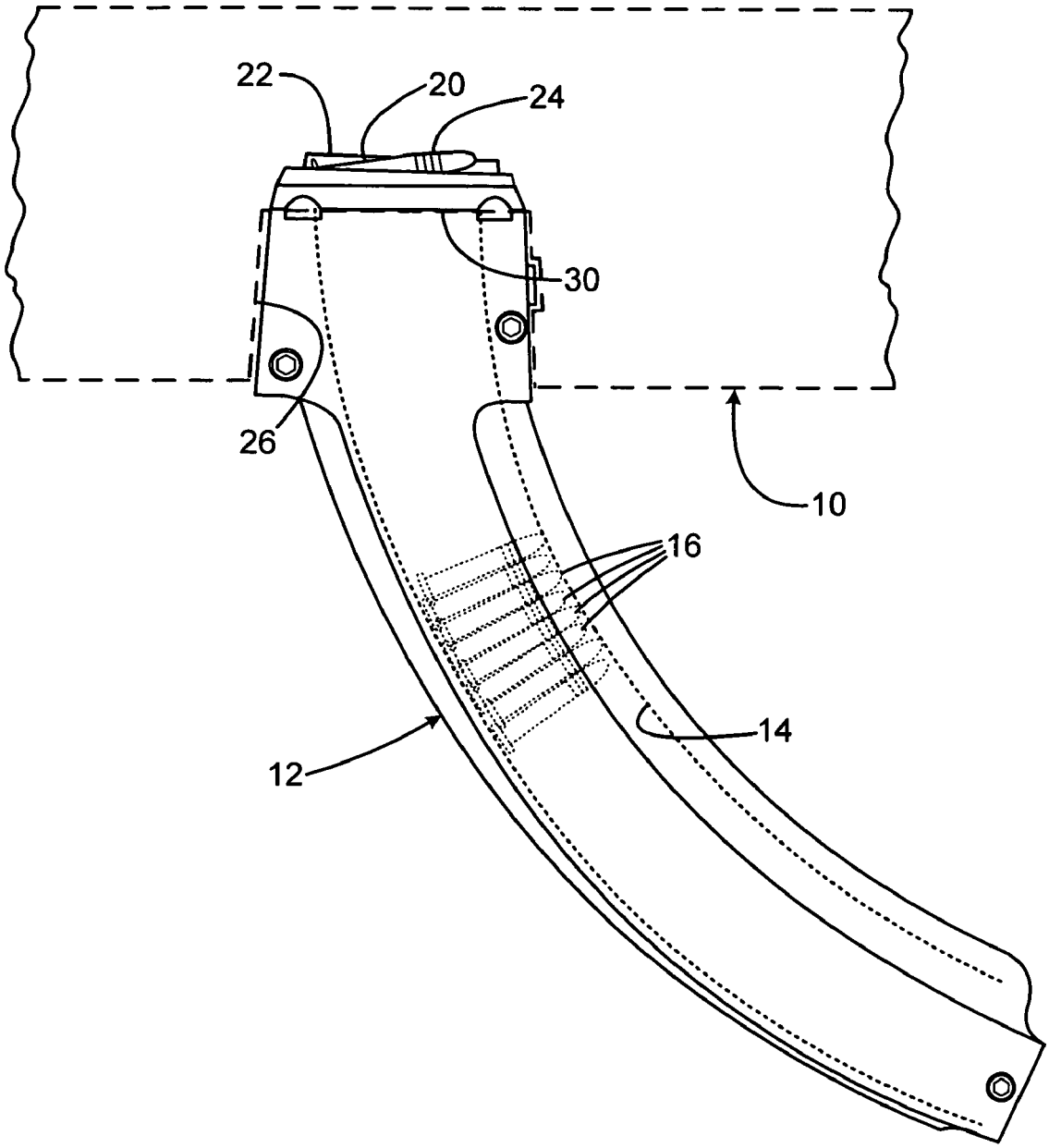
FIG. 2 is a side view of the magazine of FIG. 1.

FIG. 1 shows a rifle 10 in which a magazine 12 is inserted. The rifle is a Ruger 10/22, 77/22, Intratec TEC22 or similar firearm capable of using the same magazine. As shown in FIG. 2, the magazine is of conventional form, defining a chamber 14 in which a stack of cartridges 16 are received. The magazine includes a spring driven follower (not shown) at the lower end of the stack of the cartridges to bias the cartridges upward to an upper opening 20 defined by a pair of feed lips 22, which retains the uppermost cartridge 24 so that it can be stripped by the bolt of the rifle.

Figure 3:
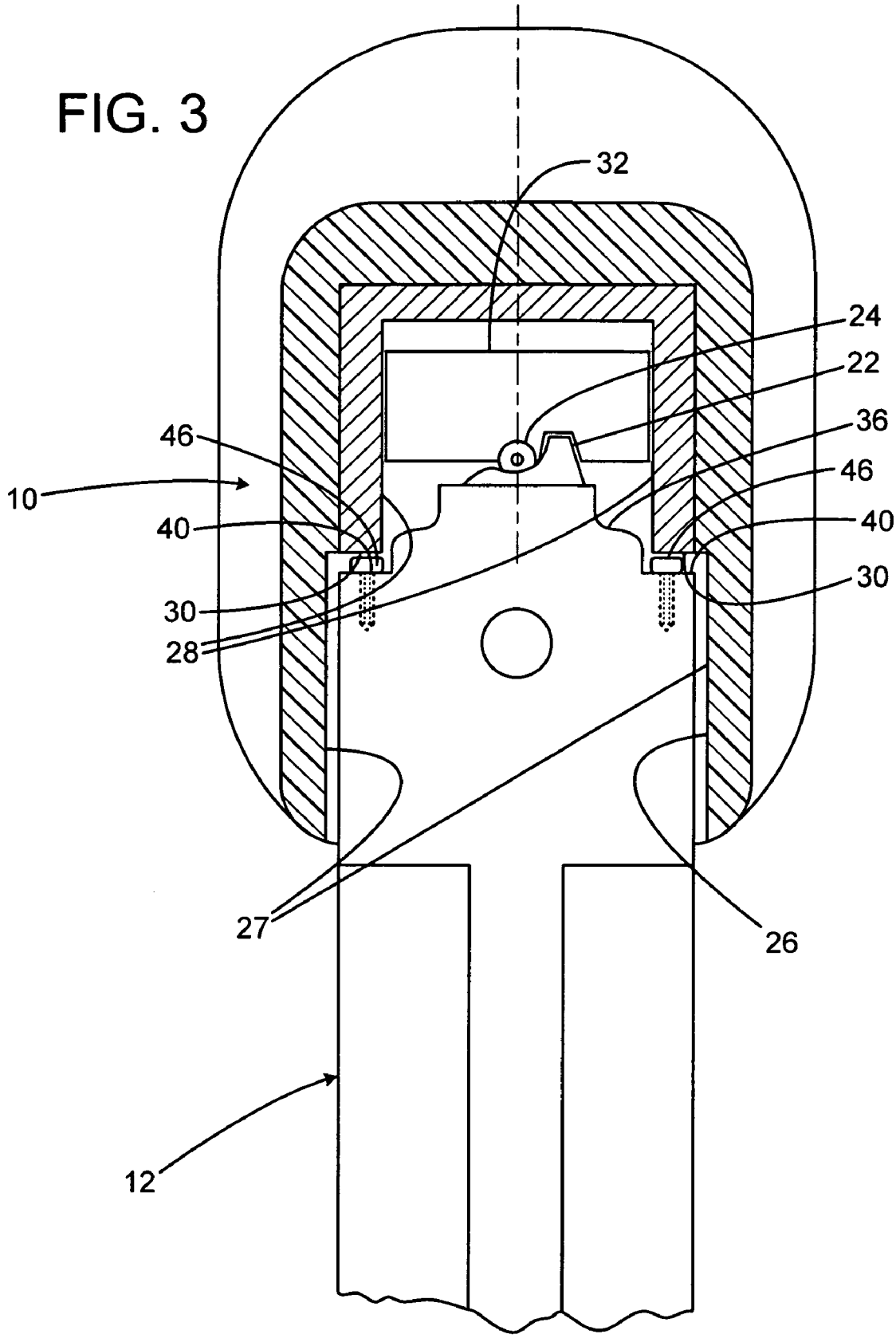
FIG. 3 is a sectional end view of the magazine of FIG. 1.

As further shown in FIG. 3, the rifle has a receiver frame 25 that defines a magazine well 26 that is open downwardly. The right and left sides 27 of the well have a depth limit defined by a receiver side frame rail 28 having a lower surface 30 that faces downwardly. The frame rails are spaced apart so that the cartridge 24 may feed upwardly between them for operation of the firearm, whereby the bolt 32 may strip the protruding cartridge.

Figure 4:
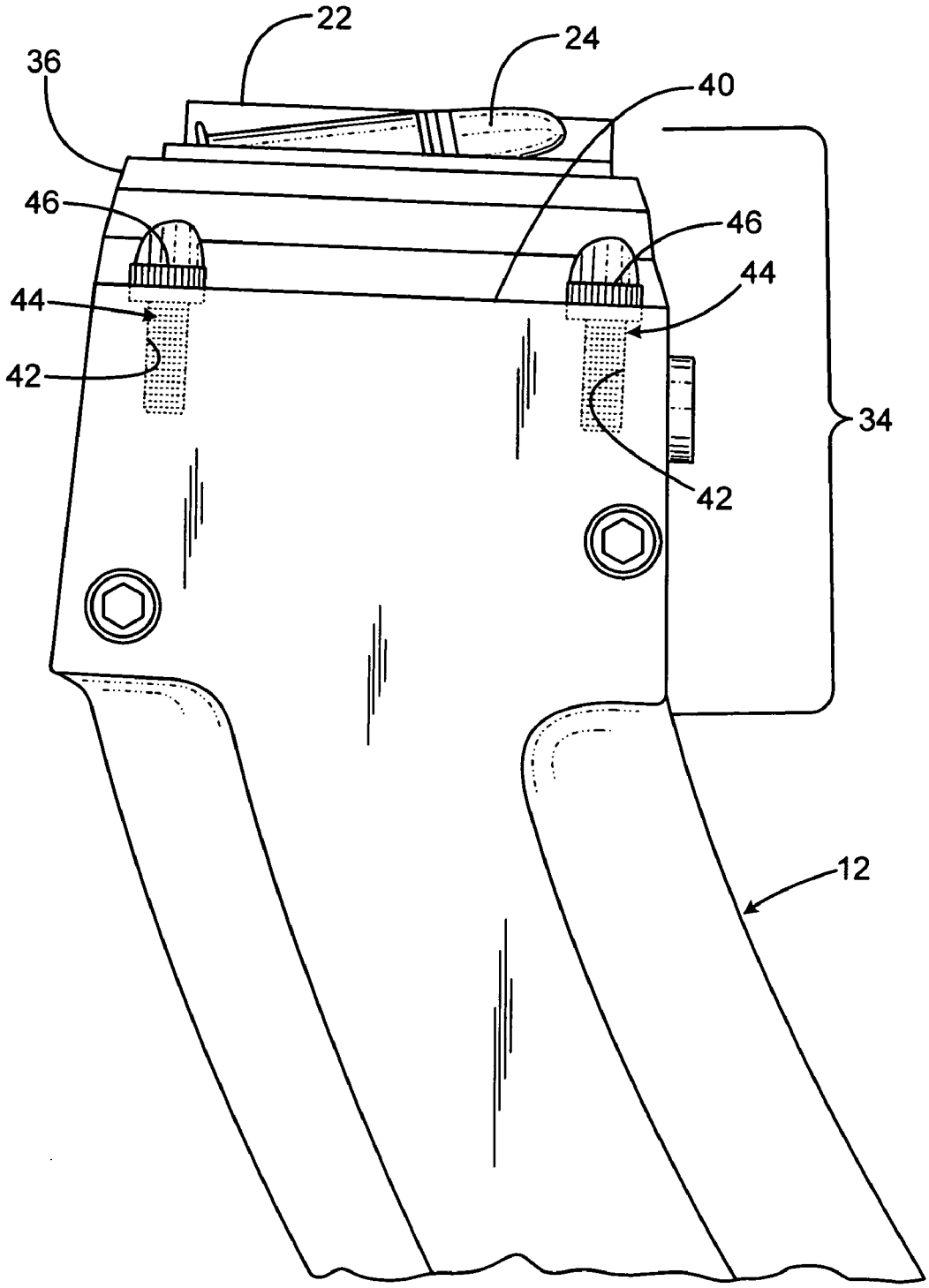
FIG. 4 is an end view of the magazine of FIG. 1.

As shown in FIG. 4, the magazine 12 has an upper block portion 34 that is received by the magazine well. The upper end of the block portion has a central rise 36 that supports the feed lips 22, and which is flanked by right and left side shoulder surfaces 40 that face upward, and extend front to back on the magazine's upper surface.

Near the front and rear end of each of the shoulder surfaces 40, a threaded bore 42 is defined. The threaded bores extend vertically, perpendicular to the shoulder surface 40. An allen head screw 44 is received in each of the bores, and has a head 46 that protrudes above the surface 40 by an adjustable selected amount. As shown in FIG. 3, the upper surfaces of the heads 46 are positioned to provide the direct points of contact with the rail surfaces 30, thus determining the precise height and angle of the magazine within the magazine well, providing a feed angle, feed height and ejector angle that can each be set for optimal location for an individual firearm by the user.

Figure 5:
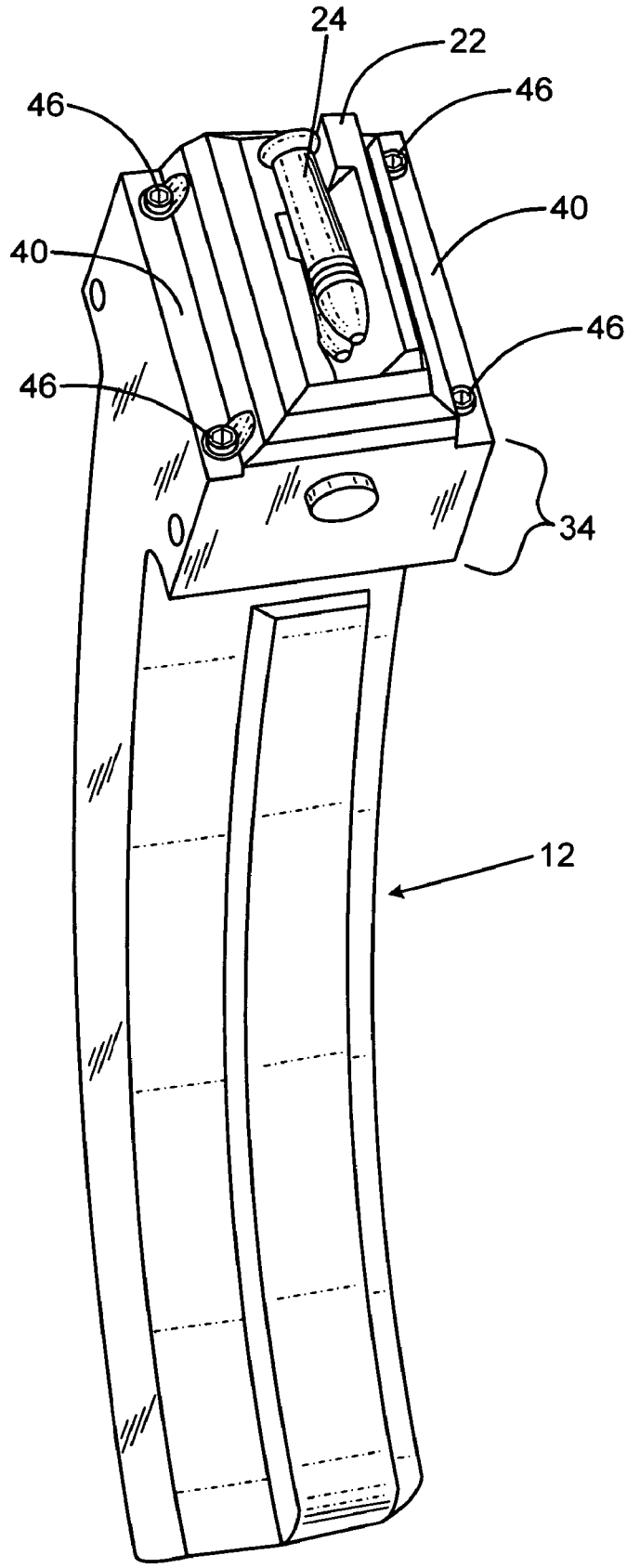
FIG. 5 is a perspective view of the magazine of FIG. 1.

FIG. 5 shows the four screw heads 46 position at respective corners of the magazine block 34. The screws may be adjusted to provide a range of angle adjustments. Adjustment of the front screws relative to the rear screws (or vice versa) adjusts the conventional feed angle. Adjustment of the right screws with respect to the left screws provides a lateral angular alignment adjustment.

While the above is discussed in terms of preferred and alternative embodiments, the invention is not intended to be so limited. For instance, not all four corners need be adjustable screws. Where feed angle is the only concern, that may be achieved by only one or two screws, at either the forward or rearward end of one or both shoulders 40. The other corners may be provided with nonmoving solid bosses. Also, the adjustment may be made by means other than screws, such as by inserts of different lengths that are press fit into holes, or by protrusions that may be shortened by material removal.

The invention claimed is:

1. A detachable magazine for a firearm having a magazine receiving portion with a magazine contact surface, the magazine comprising:

a body defining a chamber for receiving ammunition;

the body defining an opening providing communication with the chamber for charging the magazine with ammunition and for feeding ammunition from the chamber to the firearm;

the magazine having a receiver contact portion associated with the opening; and the receiver contact portion having at least an adjustable element configured to contact the magazine contact surface of the firearm to adjust the position of the magazine relative to the firearm.

2. The magazine of claim 1 wherein the adjustable element is a screw.

3. The magazine of claim 1 including a plurality of adjustable elements.

4. The magazine of claim 1 wherein the magazine contact surface includes a plurality of points in a common plane, and wherein an adjustable element contacts each of the plurality of points.

5. The magazine of claim 1 wherein the receiver interface portion is a rectangular block that inserts into the magazine receiving portion, and wherein the block has four corners, with an adjustable element associated with each corner.

6. The magazine of claim 1 wherein the magazine is inserted into the magazine receiving portion in an upward direction when the firearm is in an upright position for horizontal firing, and wherein the adjustable element is vertically adjustable.

7. The magazine of claim 6 wherein the adjustable element extends perpendicularly from a horizontal surface.

8. The magazine of claim 1 wherein the body defines a threaded bore receiving the adjustable element.

9. The magazine of claim 1 including a plurality of adjustable elements, each adjustable element being threadably received in the body, and having a free end operable to contact the magazine contact surface.

* * * * *